US007210760B2

(12) United States Patent
Monclus et al.

(10) Patent No.: US 7,210,760 B2
(45) Date of Patent: May 1, 2007

(54) HANDLING DEVICE FOR A REPLACEABLE CONSUMABLE OF A PRINTHEAD SERVICE STATION OF A PRINTING DEVICE

(75) Inventors: Antonio Monclus, Barcelona (ES); Macia Sole, Barcelona (ES); Henry Poskitt, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 293 days.

(21) Appl. No.: 10/882,410

(22) Filed: Jul. 2, 2004

(65) Prior Publication Data

US 2005/0030324 A1 Feb. 10, 2005

(30) Foreign Application Priority Data

Jul. 29, 2003 (EP) ..... 03102334

(51) Int. Cl.
*B41J 2/165* (2006.01)

(52) U.S. Cl. ..... 347/29

(58) Field of Classification Search ..... 347/29, 347/30, 32, 33, 36
See application file for complete search history.

(56) References Cited

U.S. PATENT DOCUMENTS 3,735,701 A * 5/1973 Ackerman ..... 101/269
4,634,304 A * 1/1987 Narushima et al. ..... 400/691
5,864,348 A 1/1999 Fritsch et al.
6,179,401 B1 * 1/2001 Stephens et al. ..... 347/19
6,494,633 B1 12/2002 Crosby et al.
6,581,795 B1 * 6/2003 Schulein et al. ..... 220/212.5
6,609,788 B2 * 8/2003 Hatasa et al. ..... 347/86

FOREIGN PATENT DOCUMENTS

EP 0 863 010 9/1998

* cited by examiner

*Primary Examiner*—Anh T. N. Vo
(74) *Attorney, Agent, or Firm*—Foley & Lardner LLP

(57) ABSTRACT

Disclosed is a handling device which comprises a lid, which may be arranged to cover at least partially a surface of a replaceable consumable of a printhead service station, engagement members for engaging the lid to the consumable, and a hand grip. The consumable may be replaced by engaging the handling device with the consumable while the latter is still in the service station, and removing the consumable from the service station with the handling device. The risk of getting ink on the user's hands when replacing a consumable is reduced.

21 Claims, 4 Drawing Sheets

HANDLING DEVICE FOR A REPLACEABLE CONSUMABLE OF A PRINTHEAD SERVICE STATION OF A PRINTING DEVICE

BACKGROUND

The present invention relates to a handling device for a replaceable consumable of a printhead service station of a printing device.

An inkjet printing apparatus comprises one or more printheads, which perform printing by ejecting drops of ink on a printing media through a plurality of nozzles.

In order to avoid build up of dirt, dry ink or other sources of obstruction in the printhead nozzles, and to maintain an optimum printing quality, the apparatus is typically provided with a service station to perform cleaning and maintenance operations on the printheads.

The service station is arranged within the printing apparatus, either stationary or on a movable carriage, and usually includes a capping module for covering the printheads when the printer is not is use, a wiping module comprising elastomeric wipers for wiping the printheads, and a spittoon module.

A spittoon is a reservoir for waste ink, into which the printheads eject or fire a number of drops of ink in a servicing operation known as "spitting", with the aim of clearing the nozzles of the printhead from clogs and prevent their obstruction.

Typically, the printheads can be moved over the service station for maintenance.

The modules of the service station that have been described may be consumable elements, especially in the case of large format printers, and they need to be replaced by the user with a certain frequency; for this purpose the user has to remove the old consumable from the apparatus and put a new one in its place. When the service station is mounted on a carriage, the carriage is moved towards a maintenance position to allow the user to perform the replacement more easily.

However, when the user replaces a consumable of the service station there is a risk that he gets soiled with ink when gripping and handling the consumable elements that need to be replaced; this is due to the fact that the surfaces of the consumables of the service station usually become dirty with ink during the printhead servicing operations.

Most of the ink on the service station surfaces is caused by the spitting operation: not only because of the ink drops actually fired by the printhead, but especially due to the fact that during spitting a cloud or aerosol of ink arises all around the printhead and thus over the service station, and eventually deposits on the exposed surfaces.

Another source of such dirt is the ink that is projected from the elastomeric wipers during wiping of the printhead nozzles.

Over time, the soiling of the consumables can become quite important, especially if the apparatus and the service station are designed such that replacement of the consumables is not required often.

The aerosol may soil not only the spittoon module, but also other parts of the service station and other consumables that are located nearby.

Some printing apparatus have for each printhead a single cleaning element that includes the capping, wiping and spittoon modules, such that the user replaces the whole cleaning element when needed. Such a structure is described for example in U.S. Pat. No. 6,402,290, assigned to the present applicant; in this document, the cleaning elements are provided with a handle at the front portion thereof, away from the spittoon module, that is located in its turn at the back of the cleaning element (as viewed from the front of the printing apparatus).

Thus, the handle can be kept relatively clean and there is a relatively small risk that the user gets ink on his hands when replacing the consumable.

However, in some printers each module of the service station is a separate consumable element and needs to be replaced separately from the others, because each consumable has a different life: caps depend on aerosol dirtiness, wiper on ink accumulation and spittoon on the available capacity. In this case more handles would be needed, at least some of which cannot be protected from the ink aerosol.

Another factor/that increases the possibility that the user gets ink on his hands when replacing the consumables is the desirable tendency of dimensioning and structuring service stations such as to allow consumables to be replaced only rarely, e.g. once a year: in this case, the amount of ink that may build up on the surfaces of the consumables may be quite large.

In the case of the spittoon, apart from the ink that is deposited on the surfaces, there is a further problem in that the module to be replaced may contain liquid ink that can spill if the user tilts the module.

The present invention seeks to improve the operation of replacement of a consumable element of a printhead service station by a user, and reduce the risk of ink stains.

SUMMARY

According to one aspect of the present invention, a handling device for a replaceable consumable of a printhead service station of a printing device comprises:

a lid member, intended to cover at least partially surface of a consumable to be replaced;

engagement means for engaging said lid member to said consumable; and gripping means.

Such a handling device allows a user to remove a consumable from the service station without the need of touching any of its surfaces, and thus without the risk of getting ink on his hands. The removal is performed safely and easily by virtue of the gripping means.

Said engagement means may be releasable; this allows the handling device to be disengaged from the consumable, if desired, e.g. in order to recycle the parts., and it also allows to provide a handling device coupled to every replacement part for the disposable.

The engagement means may comprise snap elements; this feature makes the engagement very fast and simple.

The device may further comprise means to release the consumable to be replaced from the service station.

This feature avoids the need to provide an independent system for the release of the consumable prior to its handling with the handling device.

In some embodiments, said lid member is such as to cover substantially all the surface of said consumable that is exposed to ink drops or to ink aerosol during a servicing operation when the consumable is in the service station.

Thus, there is no risk that the user gets ink on his hands, clothes, etc. by touching accidentally a dirty surface.

In some cases the handling device may comprise a sealing member between the lid member and the consumable.

This reduces the possibility of ink spills from the consumable, and it is particularly useful when the handling device is associated to a spittoon module.

In some embodiments of the invention, said handling device is associated to a replacement part for said consumable. In this case the handling device is always at hand and ready when a consumable has to be replaced.

The handling device may be disposable. This has the advantage that the user, after removal of the consumable from the service station, does not need to perform any further operation on the device and the consumable attached to it, and just disposes of the assembly suitably.

According to a second aspect, the present invention relates to a handling device for replacing a consumable of a printhead service station of a printing device, said handling device comprising:

a lid, shaped to cover at least partially a surface of a consumable to be replaced;

at least one engagement member for engaging said lid to said consumable; and a hand grip for gripping said lid.

According to a further aspect, the present invention relates to a replacement assembly for replacing;

a consumable of a printhead service station of a printing device, comprising a replacement part for said consumable and a handling device, said handling device comprising:

a lid member, intended to cover at least partially a surface of a consumable to be replaced;

engagement means for engaging said lid member to said consumable; and gripping means.

According to another aspect, the invention relates to a consumable for a printhead service station of a printing device, wherein said consumable comprises means for engagement to a handling device as described.

Said consumable may be at least one of a capping module, a spittoon module or a wiping module.

In another aspect, the invention relates to a printhead service station for a printing device, said service station being provided with at least one consumable as described.

In embodiments of the invention, said consumable is at least one of a capping module, a wiping module and a spittoon module; each of said modules may be an integral member that serves all the printheads.

In a further aspect, the present invention provides a method for replacing a replaceable consumable of a printhead service station of a printing device, said method comprising the steps of:

providing a handling device for said replaceable consumable, said handling device comprising a lid member, intended to cover at least partially a surface of the consumable to be replaced, engagement means for engaging said lid member to said consumable, and gripping means;

engaging said handling device with said consumable while the latter is still in said service station; and removing said consumable from the service station by means of said handling device.

The method may further comprise releasing the consumable from the service station during the engagement of the handling device with the consumable.

In some embodiments, said handling device is provided together with a replacement part of said consumable.

In this case, the handling device may be provided engaged to said replacement part, and the method may further comprise the step of releasing the handling device from the replacement part before engaging it with the consumable in the service station.

The method may also comprise the step of disposing of said handling device together with the consumable to be replaced.

BRIEF DESCRIPTION OF THE DRAWINGS

Particular embodiments of the present invention will be described in the following, only by way of non-limiting example, with reference to the appended drawings, in which.

DETAILED DESCRIPTION

Figure 1:
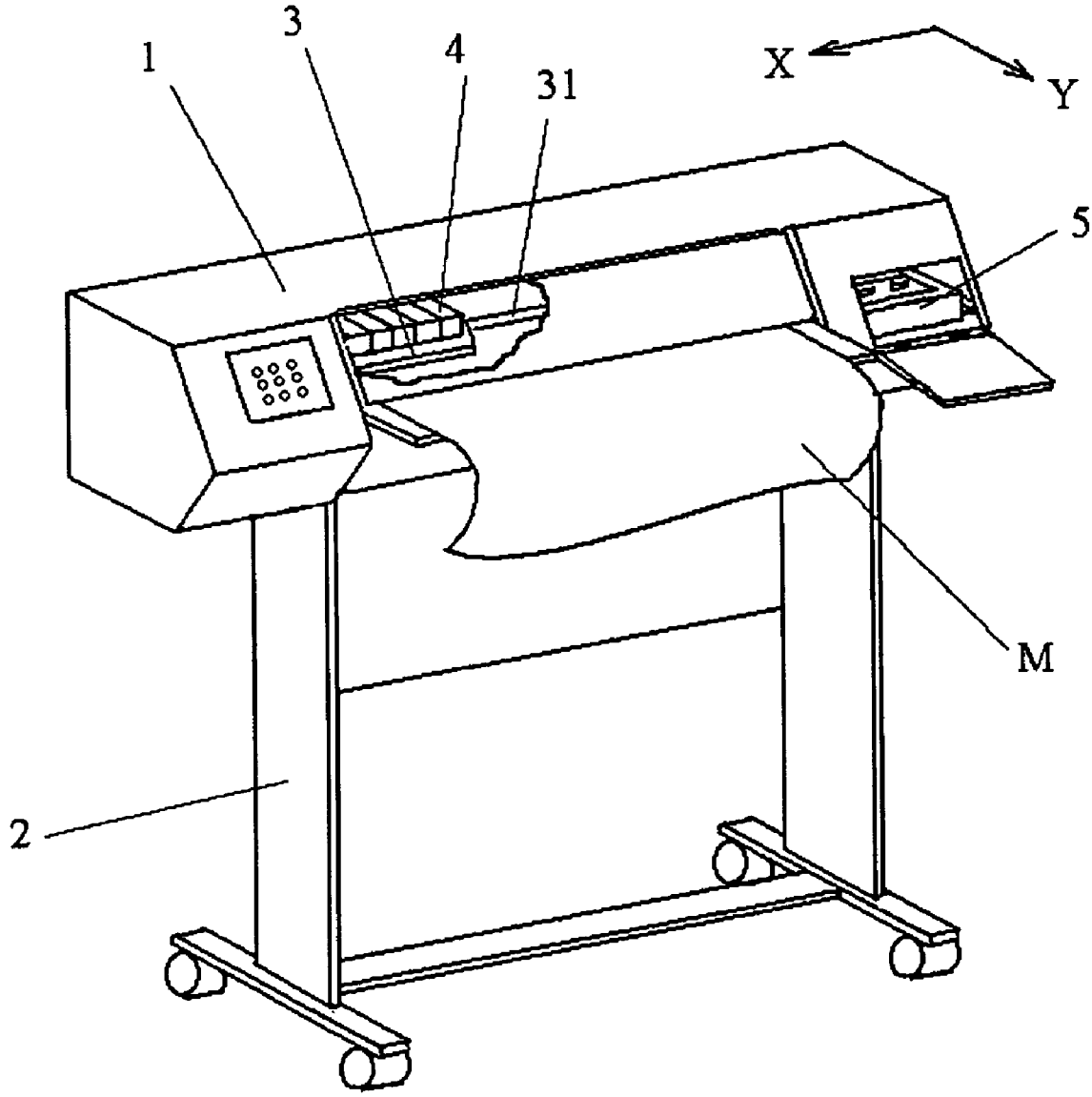
FIG. 1 shows a perspective view of an ink-jet printing apparatus having a printhead service station.

FIG. 1 illustrates an embodiment of an ink-jet printing apparatus that comprises a housing 1 mounted on a stand 2, means (not shown) for advancing a media M to be printed through the apparatus, and a reciprocating printhead carriage 3 on which inkjet printheads 4 are arranged. The printhead carriage 3 reciprocates on a guide rod 31 along a scan axis X for printing on the underlying media M.

At one end of the housing 1 is arranged a printhead service station 5, in a position such as to allow the printhead carriage 3 to be moved over the station for performing maintenance operations on the printheads 4.

Figure 2:
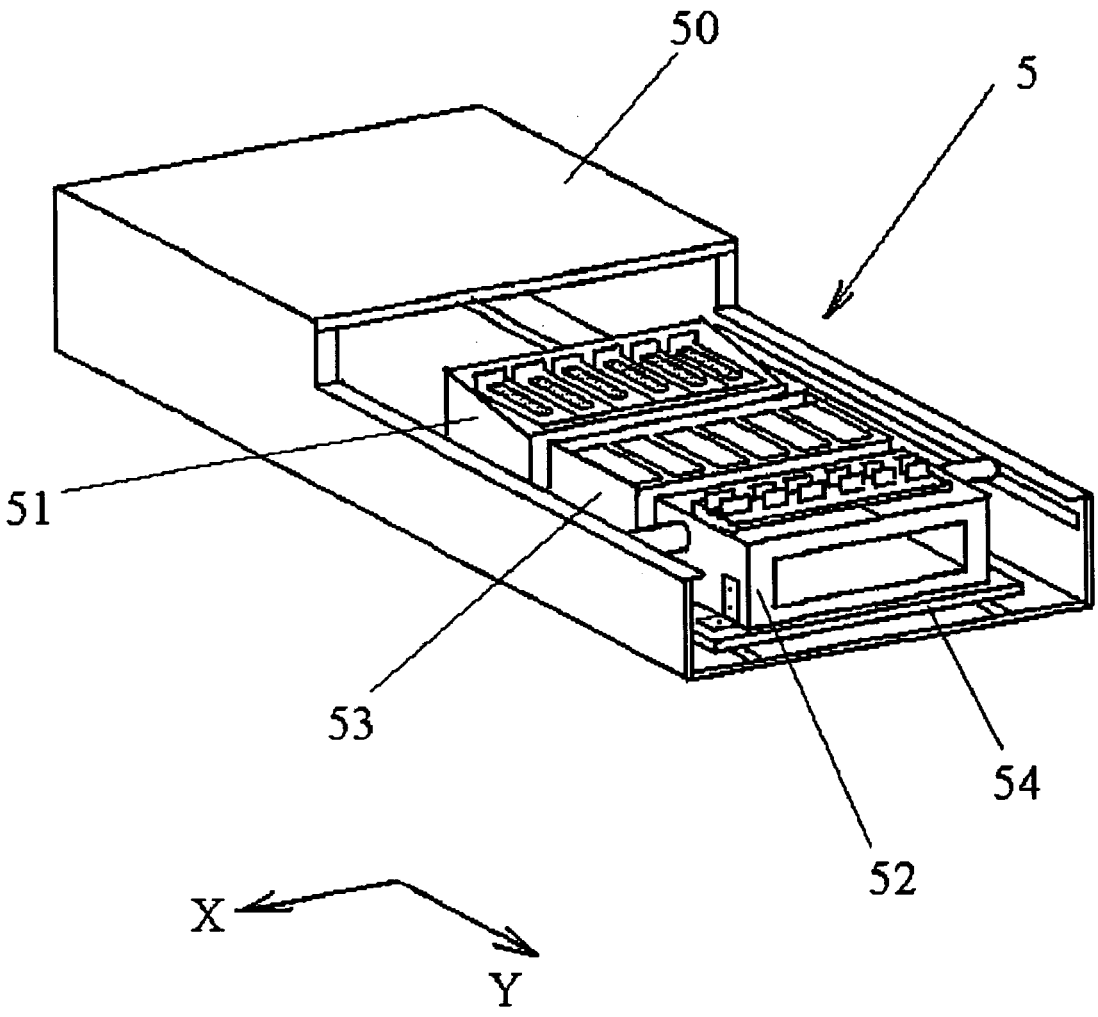
FIG. 2 shows a perspective view of a service station having separate modules for each cleaning function.

FIG. 2 shows in more detail an embodiment of a service station with consumable elements, where the handling device according to the present invention can be applied.

In FIG. 2 the service station 5 comprises an enclosure 50 in which are arranged: a capping module 51, which has the purpose of covering the printheads when the apparatus is not in use, so that they are protected from dust and the ink is prevented from drying; a wiping module 52, comprising a plurality of moveable elastomeric wipers whose function is to wipe the nozzles of the printheads to remove ink residue, dust and debris; and a spitting module or spittoon module 53, which consists essentially in a waste ink reservoir into which the printheads fire a number of droplets of ink with the purpose of clearing the nozzles from clogs, dirt, dried ink and the like.

The spittoon module 53 may comprise a foam absorber or other means for avoiding ink spills, as described in the earlier patent applications that have been mentioned above.

In this example each of the modules 51,52 and 53 is an integral member that serves all the printheads, although this may be different in other service station embodiments. Here, each module comprises a number of appropriate service elements, one for each printhead; FIG. 2 shows an example of a service station for six printheads.

The service station 5 is mounted on a service station carriage 54 displaceable in a direction Y, at right angles to the scan axis X, for selectively placing each of the modules in a suitable position under the printheads, in order to perform the corresponding servicing operation.

Figure 4A:
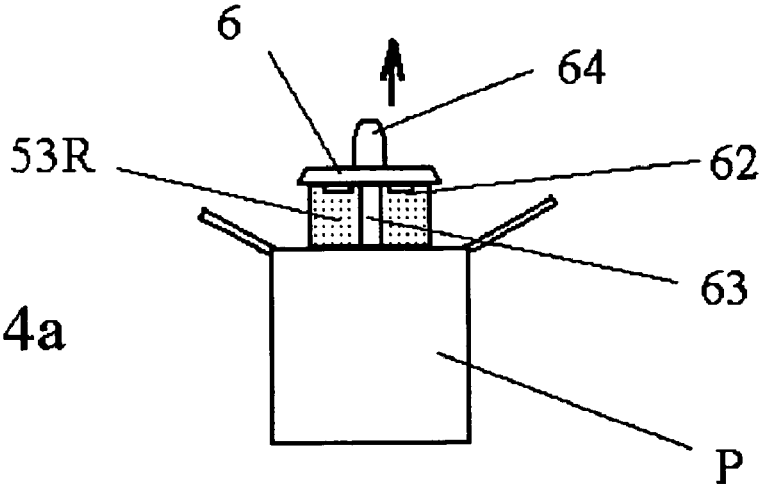
FIGS. 4*a* to 4*d* show four steps of an embodiment of a method that uses a handling device according to the present invention for replacing a consumable of a service station.
Figure 4B:
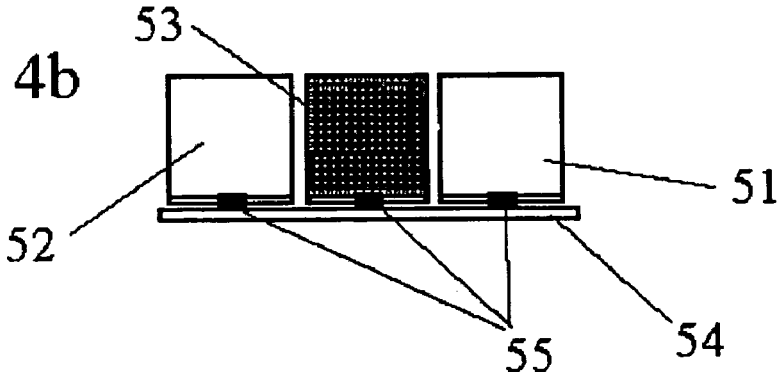
Figure 4C:
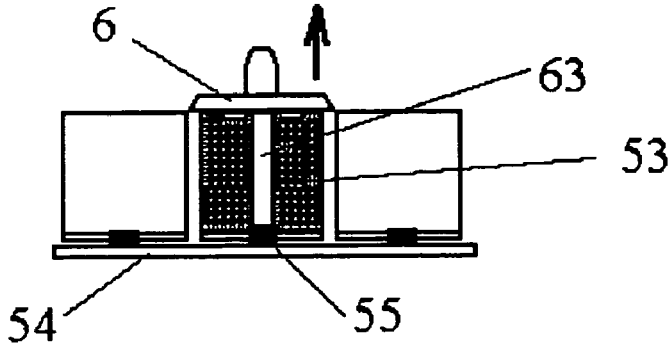
Figure 4D:
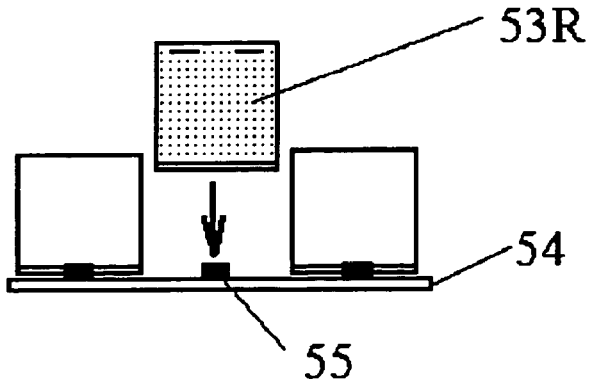

The three modules are releasably attached to the carriage 54, for example by means of toothed projections that engage a rim at the bottom of the consumable (not shown in this figure and only schematically in FIGS. 4*b* to 4*d*, where the toothed projections are indicated with reference 55).

As shown in FIG. 2, the capping module 51 is located at the rear side of the carriage 54 as seen from the front of the apparatus, the spittoon module 53 is in the centre of the carriage and the wiping module 52 is located at the front side of the carriage, thus being more easily accessible to the user.

As described above, in this case the service station modules are consumable elements that need to be replaced over time; as explained before, in the embodiment shown in FIG. 2 each module 51,52 and 53 is an integral ember and is independent from the others, and each of them may be replaced when appropriate.

During the spitting and wiping operations the whole of the service station, and especially the spittoon module 53, become dirty due to the ink aerosol and ink drops ejected from the printheads or caused by the wipers.

Also the capping module becomes quite dirty because it is very close to the spittoon; and the capping module reliability depends on the sealing capability, which can be damaged by the aerosol and dust.

All the surfaces that remain exposed during the cleaning operations, i.e. at least the upper surfaces of the capping, spitting and wiping modules, will receive ink drops and aerosol and will become dirty.

In the context of the present specification and claims, by exposed surface it is meant a surface that is exposed to ink drops and aerosol during any of the servicing operations performed on a printhead in the service station.

Figure 3:
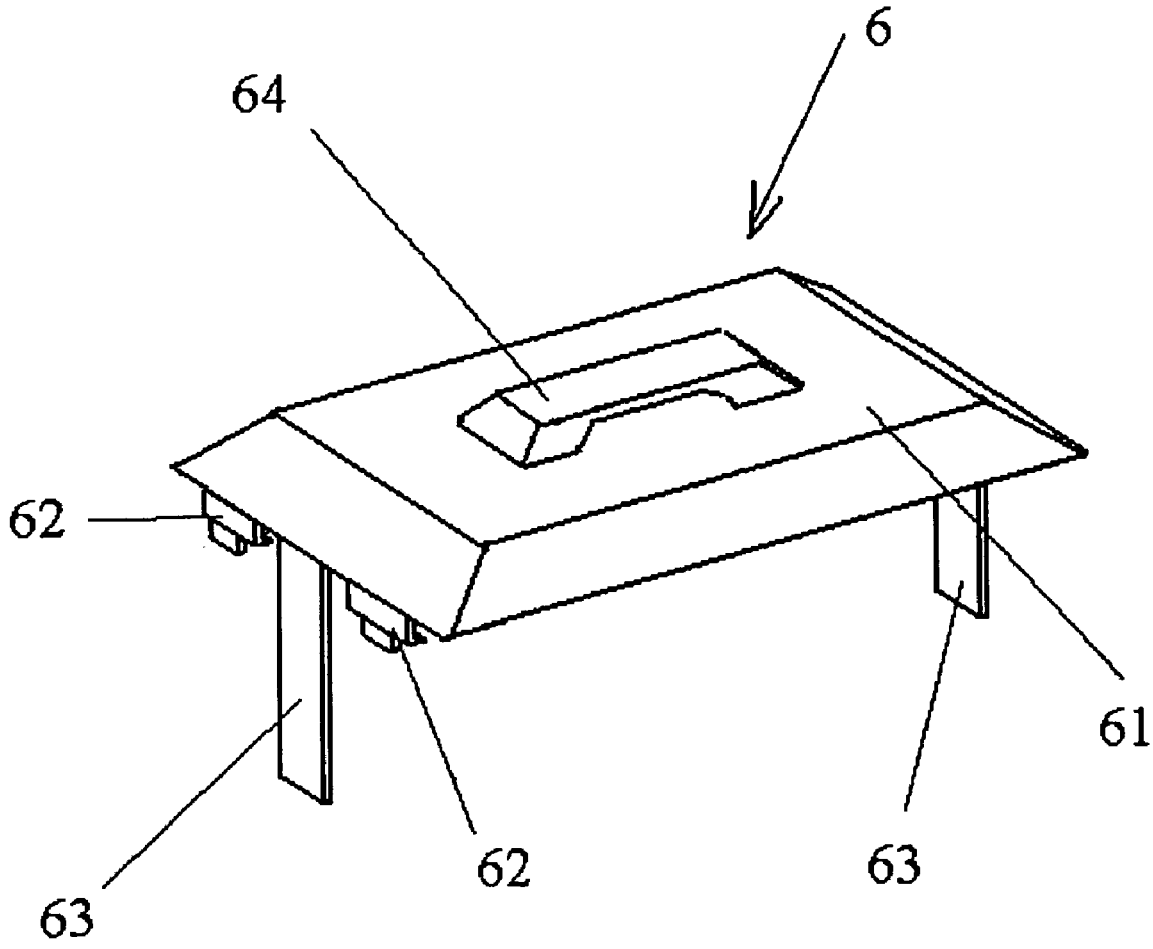
FIG. 3 shows in perspective one embodiment of a handling device according to the present invention.

For the purpose of preventing a user from getting dirty, i.e. getting ink on his hands, during the replacement of any of the consumables, in one embodiment the present invention provides a handling device 6 as shown in FIG. 3.

The handling device 6 comprises, in the example shown in enlarged view in FIG. 3, a lid portion 61 which is dimensioned such as to cover substantially all the exposed surface of the consumable; in this example the handling device 6 will be described applied to the spittoon module 53. It will be understood that an equivalent handling device may be applied to the other modules. It is also possible to design a lid that may be used for all three consumables, since their size is very similar.

At the periphery of the lid portion 61 there are snap engagement elements 62 (only those at one side being visible in the figure) which cooperate with complementary engagement elements (not shown) provided on the consumable 53. As shown in the figure, the engagement elements 62 may be resilient tabs provided with a tooth, such that the tooth is engaged in complementary openings in the side wall of the disposable element. However, it has to be noted that any other suitable engagement system can be used.

The device 6 also comprises two elongate tabs 63 for releasing the corresponding module from the carriage 54: when the lid portion is placed on the consumable 53, the tabs 63 unclip the toothed projections from the rim at the bottom of the consumable, thus releasing the latter from the carriage 54. The engagement between the handling device 6 and the consumable 53 is releasable by the user. In FIG. 3, the tabs 63 are shown with a projecting tongue at their lower end: the user may pull the tongues outwards for releasing the tooth from the opening in the side wall of the disposable element.

The device 6 also comprises two elongate tabs 63 for releasing the corresponding module from the carriage 54: when the lid portion is placed on the consumable 53, the tabs 63 unclip the toothed projections from the rim at the bottom of the consumable, thus releasing the latter from the carriage 54.

It has to be noted that the means of engagement of the consumable to the carrier, and therefore the means provided on the handling device to release said engagement, may be of any other kind.

The handling device 6 may also be provided with a suitable seal (not shown) at the periphery of the lid portion 61, in order to avoid any spill of liquid from the spittoon module 53 when it is being replaced.

On the outer and upper side of the lid portion is formed a gripping handle 64, such that the device may be easily and safely held by the user.

In the following a method according to an embodiment of the invention, for replacing a replaceable consumable of a printhead service station of a printing device, will be described with reference to FIGS. 4*a* to 4*d*.

According to this method, a handling device 6 is provided together with a replacement part, for example a replacement part 53R for a spittoon module.

The user removes the replacement part 53R together with the handling device 6 from the corresponding package P (FIG. 4*a*).

FIG. 4*b* shows very schematically a side view of the service station carriage 54 with the capping module 51 and wiping module 52, the spittoon module 53 that needs to be replaced, and the toothed tongues 55 that engage a rim at the bottom of each consumable in order to maintain it engaged to the carriage 54.

Once removed the replacement part 53R from the package, the user releases the handling device 6 from the replacement part, which is new and therefore clean from ink and can be handled safely, and applies it onto the spittoon module 53 that needs to be replaced (FIG. 4*c*), and that is soiled with ink.

The device engages the module 53 by virtue of the engagement means 62, and at the same time releases the consumable from the service station carriage 54 by means of the tabs 63 that press the toothed tongues 55 out of engagement with the rim of the consumable.

The user can then remove the module from the service station carriage 54, by gripping and pulling up the handling device 6 and the module 53 attached to it with no risk of getting ink on his hands, since the exposed surfaces of the module 53 remain covered by the lid portion 61 of the device 6, and the user does not need to touch the module at all.

Then the user places by hand the new and clean replacement part 53R in position in the carriage 54, as shown in FIG. 4*d*, and may dispose of the old spittoon module as necessary.

The user can dispose of the handling device 6 together with the consumable 53, such that, on one hand, he does not need to disengage them, and, on the other hand, the module is kept safely sealed and provided with handling means at all times while under the user's control.

Although the present specification describes embodiments of the invention by way of example, it has to be noted that many variants are possible. For instance, the handling device does not need to be disposable, and is not necessarily associated to a replacement part; and, when supplied together with the replacement, it may be engaged to the replacement or separate from it. In the latter case, the engagement means don't need to be releasable by the user. The gripping means may be of any other type and shape suitable for the purpose.

The invention claimed is:

1. A handling device for a replaceable consumable of a printhead service station of a printing device, said handling device comprising:

a lid member, intended to cover at least partially a surface of a consumable to be replaced;

engagement means for engaging said lid member to said consumable;

gripping means for gripping said lid; and releasing means for releasing the consumable to be replaced from the service station.

2. A handling device as claimed in claim 1, wherein said engagement means are releasable.

3. A handling device as claimed in claim 1, wherein said engagement means comprise snap elements.

4. A handling device as claimed in claim 1, wherein said lid member is such as to cover substantially all the surface of said consumable that is exposed to ink drops or to ink aerosol during a servicing operation when the consumable is in the service station.

5. A handling device as claimed in claim 1, wherein said device is associated to a replacement part for said consumable.

6. A handling device as claimed in claim 1, wherein said handling device is disposable.

7. A handling device as claimed in claim 1, wherein said releasing means includes a tab extending from the lid member, the tab configured to detach the consumable from the service station when the handling device is being engaged with the consumable.

8. A handling device as claimed in claim 1, wherein the gripping means is centrally located on the lid member.

9. A handling device for a replaceable consumable of a printhead service station of a printing device, said handling device comprising:

a lid member, intended to cover at least partially a surface of a consumable to be replaced;

engagement means for engaging said lid member to said consumable;

gripping means for gripping said lid;

a sealing member between the lid member and the consumable; and releasing means for releasing the consumable to be replaced from the service station.

10. A handling device for replacing a consumable of a printhead service station of a printing device, said handling device comprising:

a lid, shaped to cover at least partially a surface of a consumable to be replaced;

at least one engagement member for engaging said lid to said consumable;

a hand grip for gripping said lid; and releasing means for releasing the consumable to be replaced from the service station.

11. A consumable for a printhead service station of a printing device, the consumable comprising:

means for engagement to a handling device, said handling device comprising:

a lid member, intended to cover at least partially a surface of a consumable to be replaced;

engagement means for engaging said lid member to said consumable;

gripping means centrally located on the lid member; and releasing means for releasing the consumable to be replaced from the service station.

12. A consumable as claimed in claim 11, said consumable being at least one of a capping module, a spittoon module or a wiping module.

13. A printhead service station for a printing device, the printhead service station comprising:

at least one consumable which comprises means for engagement to a handling device, said handling device comprising:

a lid member, intended to cover at least partially a surface of a consumable to be replaced;

engagement means for engaging said lid member to said consumable;

gripping means centrally located on the lid member; and releasing means for releasing the consumable to be replaced from the service station.

14. A printhead service station as claimed in claim 13, wherein said consumable is at least one of a capping module, a wiping module and a spittoon module.

15. A printhead service station as claimed in claim 14, wherein each of said modules is an integral member that serves all the printheads.

16. A method for replacing a replaceable consumable of a printhead service station of a printing device, said method comprising the steps of:

providing a handling device for said replaceable consumable, said handling device comprising a lid member, intended to cover at least partially a surface of the consumable to be replaced, engagement means for engaging said lid member to said consumable, and gripping means;

engaging said handling device with said consumable while the latter is still in said service station; and removing said consumable from the service station by means of said handling device.

17. A method as claimed in claim 16, further comprising releasing the consumable from the service station during the engagement of the handling device with the consumable.

18. A method as claimed in claim 16, wherein said handling device is provided together with a replacement part of said consumable.

19. A method as claimed in claim 18, wherein said handling device is provided engaged to said replacement part, the method further comprising the step of releasing the handling device from the replacement part before engaging the handling device with the consumable in the service station.

20. A method as claimed in claim 18, further comprising the step of disposing of said handling device together with the consumable to be replaced.

21. A replacement assembly for replacing a consumable of a printhead service station of a printing device, the replacement assembly comprising:

a replacement part for said consumable; and a handling device, said handling device comprising:

a lid member, intended to cover at least partially a surface of a consumable to be replaced;

engagement means for engaging said lid member to said consumable;

gripping means for gripping said lid; and releasing means for releasing the consumable to be replaced from the service station.

* * * * *